US010446126B1

(12) United States Patent
Kaye

(10) Patent No.: US 10,446,126 B1
(45) Date of Patent: Oct. 15, 2019

(54) SYSTEM FOR GENERATION OF MUSICAL AUDIO COMPOSITION

(71) Applicant: XJ MUSIC INC, Los Angeles, CA (US)

(72) Inventor: Nicholas Charney Kaye, San Francisco, CA (US)

( * ) Notice: Subject to any disclaimer, the term of this patent is extended or adjusted under 35 U.S.C. 154(b) by 0 days.

(21) Appl. No.: 16/159,815

(22) Filed: Oct. 15, 2018

(51) Int. Cl.
*A63H 5/00* (2006.01)
*G04B 13/00* (2006.01)
*G10H 1/00* (2006.01)

(52) U.S. Cl.
CPC ..... *G10H 1/0025* (2013.01); *G10H 1/0091* (2013.01); *G10H 2210/105* (2013.01); *G10H 2210/115* (2013.01)

(58) Field of Classification Search
CPC ..... G10H 1/0025; G10H 1/0091; G10H 2210/105; G10H 2210/115
USPC ..... 84/609
See application file for complete search history.

(56) References Cited

U.S. PATENT DOCUMENTS 6,011,212 A 1/2000 Rigopulos et al.
6,363,350 B1 3/2002 Lafe
7,053,291 B1 * 5/2006 Villa ..... G10H 1/0025 84/609
7,498,504 B2 3/2009 Bourgeois
7,626,112 B2 * 12/2009 Miyajima ..... G10H 1/0025 84/609
8,347,213 B2 1/2013 Clifton et al.
2008/0156176 A1 * 7/2008 Edlund ..... G10H 1/0025 84/609
2009/0019995 A1 * 1/2009 Miyajima ..... G10H 1/0025 84/625
2017/0092246 A1 * 3/2017 Manjarrez ..... G06F 3/04815
2017/0103740 A1 * 4/2017 Hwang ..... G10H 1/0025

* cited by examiner

*Primary Examiner* — Jeffrey Donels
(74) *Attorney, Agent, or Firm* — Michael J. Feigin, Esq.; Feigin & Fridman LLP

(57) ABSTRACT

A musical audio composition is generated based on a content library. The library is a collection of sequences and instruments. Sequences are partial musical compositions, while instruments are groups of audio samples. Instruments are made of audio data and musical data describing the events recorded in the audio. The process begins by reading the library. A new chain is created. A succession of sequences are selected to create a series of segments in the chain. The events in the selected sequences determine the selection of instruments. Algorithms determine the final arrangements and exact modulations of source audio to target outputs. The source audio are modulated, mixed and output as a stream of audio data. Finally the selections and events of the finished segment are output as metadata. An unlimited number of segments can be fabricated in series, each building and evolving from the preceding segments in the chain.

11 Claims, 19 Drawing Sheets

Artists input macro-type sequences to establish overall musical possibilities

200

| Macro-sequence | | 102 |
|---|---|---|
| Name | Getting Lonesome | 131 |
| Credit | Lonely Artist | 132 |
| Type | Macro | 133 |
| Macro-patterns | | 108 |

| Offset 0: | | Offset 1: |
|---|---|---|
| Memes: Joy | 109 | Memes: Grief |
| Key: D# | 141 | Key: D minor |
| Density: 0.6 | 140 | Density: 0.4 |
| Tempo: 128 BPM | 142 | Tempo: 110 BPM |

201

| Macro-sequence | | 102 |
|---|---|---|
| Name | Cheering Up | 131 |
| Credit | Cheerful Artist | 132 |
| Type | Macro | 133 |
| Macro-patterns | | 108 |

| Offset 0: | | Offset 1: | Offset 2: |
|---|---|---|---|
| Memes: Grief | 109 | Memes: Joy | Memes: Joy |
| Key: G minor | 141 | Key: C | Key: F |
| Density: 0.4 | 140 | Density: 0.6 | Density: 0.7 |
| Tempo: 90 BPM | 142 | Tempo: 120 BPM | Tempo: 133 BPM |

Fig. 8

Artists input main-type sequences to establish harmonic and melodic musical possibilities

203

| Main-sequence | | 102 |
|---|---|---|
| Name | Happy We Are Tonight | 131 |
| Credit | Marshall S. Pike | 132 |
| Type | Main | 133 |
| Density | 0.6 | 134 |
| Key | G | 135 |
| Tempo | 128 BPM | 136 |
| Meme | Joy, Grit | 109 |

Main-patterns 108

```
Offset 0, 64 beats total: (Meme: Joy)
  Chord: (1:beat)
    G » » » » » » » D » » » G » » » G » » » » » » » C » » » D » » »
    D » » » A » » » C » » » D » » » » » » » A » » » D » » » G » » »
  Melodic: (2:beat)
    G5  G5  G5  G5  »   G5  »   »   D6  »   »   G5  »   »   »   »
    A5  A5  »   »   A5  A5  A5  A5  G5  »   »   »   »   »   »   G5
    G5  »   »   D6  B5  »   »   G5  B5  »   »   »   G5  »   »   G5
    E5  »   A5  C6  »   »   B5  »   G5  »   »   »   »   »   »   »
    F#5 »   A5  D6  »   F#5 »   »   G5  »   F#5 F#5 »   »   »   G5
    C6  »   D6  E6  »   »   B5  »   D6  »   »   »   »   »   »   D5
    G5  »   F#5 G5  »   B5  »   »   B5  »   G5  A5  »   »   C6  »
    F#5 »   A5  C6  »   B5  »   »   G5  »   »   »   »   »   »   »

Offset 1, 64 beats total: (Meme: Joy, Grit)
  Chord: (1:beat)
    G » » » » » » » D » » » G » » » G » » » » » » » C » » » D » » »
    D » » » A » » » C » » » D » » » » » » » A » » » D » » » G » » »
  Melodic: (2:beat)
    G5  G5  G5  G5  »   G5  »   »   D6  »   »   G5  »   »   »   »
    A5  A5  »   »   A5  A5  A5  A5  G5  »   »   »   »   »   »   G5
    G5  »   »   D6  B5  »   »   G5  B5  »   »   »   G5  »   »   G5
    E5  »   A5  C6  »   »   B5  »   G5  »   »   »   »   »   »   »
    F#5 »   A5  D6  »   F#5 »   »   G5  »   F#5 F#5 »   »   »   G5
    C6  »   D6  E6  »   »   B5  »   D6  »   »   »   »   »   »   D5
    G5  »   F#5 G5  »   B5  »   »   B5  »   G5  A5  »   »   C6  »
    F#5 »   A5  C6  »   B5  »   »   G5  »   »   »   »   »   »   »
```

Fig. 9

Artists input rhythm-type sequences to establish rhythmic musical possibilities

205

| Rhythm-sequence | | 102 |
|---|---|---|
| Name | New Jack Beat | 131 |
| Credit | Upbeat Artist | 132 |
| Type | Rhythm | 133 |
| Density | 0.8 | 134 |
| Key | C | 135 |
| Tempo | 128 BPM | 136 |
| Meme | Joy, Grit | 109 |
| Rhythm-patterns | | 108 |

| Offset 0: | Offset 1: | Offset 2: |
|---|---|---|
| (2 beats total) | (2 beats total) | (2 beats total) |
| Rhythm: (4:beat) | Rhythm: (4:beat) | Rhythm: (4:beat) |
| KCK HAT HAT HAT | KCK MAR HAT AR | SNR TOM TOM SNR |
| SNR KCK HAT KCK | KCK MAR HAT CLP | TOM TOM SNR TOM |
| HI KCK HAT KCK | TOM KCK MAR TOM | TOM SNR TOM TOM |
| SNR HAT HAT HAT | KCK HAT CLP CLP | SNR TOM TOM SNR |
| (repeat) | (repeat) | (repeat) |

Fig. 10

Artists input harmonic-type instruments to establish harmonic audio possibilities

211

| Harmonic-instrument | | 103 |
|---|---|---|
| Description | Rejoice From Mountain Tops | 154 |
| Credit | Angels | 155 |
| Type | Harmonic | 153 |
| Meme | Joy | 109 |
| Audio Samples | | 114 |

VELOCITY: 0.9
TONALITY: 0.8
LENGTH: 1.91s
PITCH: 105Hz
TEMPO: 120bpm
CHORDS: C
WAVEFORM:

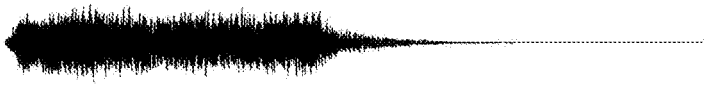

VELOCITY: 0.7
TONALITY: 0.6
LENGTH: 1.88s
PITCH: 300Hz
TEMPO: 120bpm
CHORDS: D
WAVEFORM:

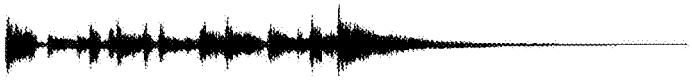

VELOCITY: 0.9
TONALITY: 0.89
LENGTH: 1.67s
PITCH: 140Hz
TEMPO: 120bpm
CHORDS: F
WAVEFORM:

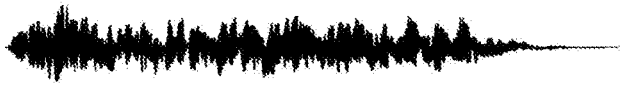

VELOCITY: 0.8
TONALITY: 0.8
LENGTH: 1.98s
PITCH: 1040Hz
TEMPO: 120bpm
CHORDS: G minor
WAVEFORM:

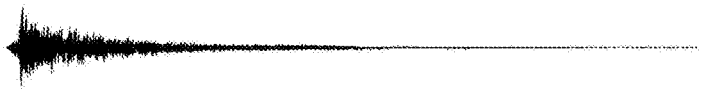

VELOCITY: 0.7
TONALITY: 0.6
LENGTH: 2.01s
PITCH: 682Hz
TEMPO: 120bpm
CHORDS: A
WAVEFORM:

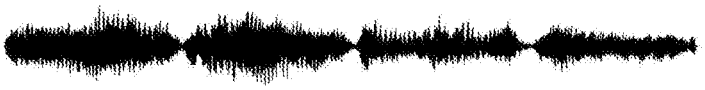

Fig. 11

Artists input melodic-type instruments to establish melodic audio possibilities

212

| Melodic-instrument | | 103 |
|---|---|---|
| Description | Blue Synth | 154 |
| Credit | Lars Feels | 155 |
| Type | Melodic | 153 |
| Meme | Grief | 109 |
| Audio Samples | | 114 |

WAVEFORM:

VELOCITY: 1.0
TONALITY: 0.95
LENGTH: 1.500s
PITCH: 262Hz
TEMPO: 120bpm
EVENTS: C4 - B3 - A#3 -

WAVEFORM:

VELOCITY: 0.9
TONALITY: 0.92
LENGTH: 4.00s
PITCH: 222Hz
TEMPO: 120bpm
EVENTS: A3 C4 A3 D4 - C4 D4 C4
D#4 - - - D4 C4 - -

WAVEFORM:

VELOCITY: 0.9
TONALITY: 0.92
LENGTH: 0.50s
PITCH: 262Hz
TEMPO: 120bpm
EVENTS: C4

Fig. 12

Artists input percussive-type instruments to establish percussive audio possibilities

209

| Rhythm-instrument | | 103 |
|---|---|---|
| Description | TR-808 Rhythm Composer | 154 |
| Credit | Roland Corporation | 155 |
| Type | Percussive | 153 |
| Meme | Joy, Nostalgia | 109 |
| Audio Samples | | 114 |

| | | |
|---|---|---|
| VELOCITY: 1.0<br>TONALITY: 1.0<br>INFLECTION: KICK<br>LENGTH: 0.865s<br>PITCH: 57Hz | WAVEFORM: | 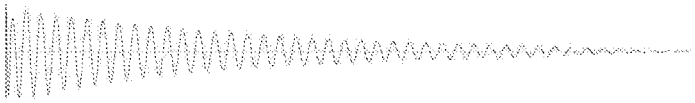 |
| VELOCITY: 1.0<br>TONALITY: 0.7<br>INFLECTION: SNARE<br>LENGTH: 0.925s<br>PITCH: 178Hz | WAVEFORM: | 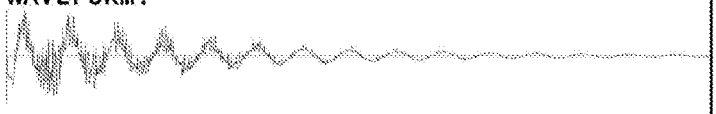 |
| VELOCITY: 0.8<br>TONALITY: 0.2<br>INFLECTION: HAT<br>LENGTH: 0.053s<br>PITCH: 6500Hz | WAVEFORM: | 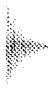 |
| VELOCITY: 0.7<br>TONALITY: 0.1<br>INFLECTION: CLAP<br>LENGTH: 0.56s<br>PITCH: 1102Hz | WAVEFORM: | 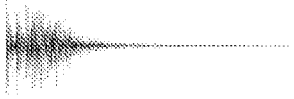 |
| VELOCITY: 0.8<br>TONALITY: 0.5<br>INFLECTION: TOM<br>LENGTH: 0.56s<br>PITCH: 104Hz | WAVEFORM: | 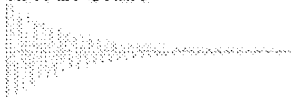 |
| VELOCITY: 0.8<br>TONALITY: 0.1<br>INFLECTION: MARACA<br>LENGTH: 0.26s<br>PITCH: 190Hz | WAVEFORM: | 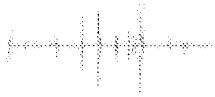 |

Fig. 13

Generated musical composition is persisted as a chain comprised of segments

| | Chain 106 | | | | |
|---|---|---|---|---|---|
| | Segment 221 | Segment 222 | Segment 223 | Segment 224 | Segment 225 |
| 172 Offset | 0 | 1 | 2 | 3 | 4 |
| 174 Start | 0 sec | 30 sec | 60 sec | 96 sec | 139 sec |
| 175 Finish | 30 sec | 60 sec | 96 sec | 139 sec | 169 sec |
| 176 Total | 64 beat | 64 beat | 64 beat | 64 beat | 64 beat |
| 177 Density | 0.6 | 0.6 | 0.4 | 0.4 | 0.6 |
| 178 Key | D# | D# | D minor | D minor | G major |
| 179 Tempo | 128 BPM | 128 BPM | 90 BPM | 90 BPM | 128 BPM |
| 109 Memes | Joy | Joy, Grit | Loss | Grief | Joy |
| 215 Macro Sequence | 200: Phase: 0 Tpose: 0 | 200: Phase: 0 Tpose: 0 | 201: Phase: 0 Tpose: -5 | 201: Phase: 0 Tpose: -5 | 201: Phase: 1 Tpose: -5 |
| 216 Main Sequence | 203: Phase: 0 Tpose: -4 | 203: Phase: 1 Tpose: -4 | 202: Phase: 0 Tpose: +2 | 202: Phase: 1 Tpose: +2 | 203: Phase: 0 Tpose: 0 |
| 217 Rhythm Sequence | 205: Phase: 0 Tpose: +3 | 205: Phase: 1 Tpose: +3 | 204: Phase: 0 Tpose: +2 | 204: Phase: 1 Tpose: +2 | 205: Phase: 0 Tpose: -5 |
| 218 Detail Sequences | 207: Phase: 0 Tpose: +3 | 207: Phase: 0 Tpose: +3<br>220: Phase: 0 Tpose: +3 | 219: Phase: 0 Tpose: +2 | 206: Phase: 0 Tpose: +2 | 207: Phase: 0 Tpose: -5 |

Fig. 14

SYSTEM FOR GENERATION OF MUSICAL AUDIO COMPOSITION

FIELD OF THE DISCLOSED TECHNOLOGY

The disclosed technology described herein relates to the generation of musical audio compositions. More particularly, the disclosed technology relates to a mathematical system to generate completely unique musical audio compositions which are never-ending, based on input content comprising partial musical compositions and instrument audio. The disclosed technology also relates to the unique structure and properties of the input content required to facilitate the execution of the algorithms described herein. The disclosed technology also relates to a unique business method employed by enabling computer technology software. The disclosed technology further relates to a computer service available over a communications link, such as a local area network, intranet or the internet that allows a musical artist to generate neverending musical audio compositions based on input content.

BACKGROUND OF THE DISCLOSED TECHNOLOGY

Electronic musical audio composition generation systems are known. Many electronic musical systems generate audio data compatible with personal and commercial multimedia players. Many electronic musical systems also provide procedural generation which is used by expert musicians. With many known electronic musical audio composition systems, in order to compose audio, the operator must manually specify the modulation of each source audio sample into an output composition. With other known electronic musical systems, the operator is not a musician at all, and a computer is relied upon for musical ingenuity. Either of these approaches are known to have significant limitations and drawbacks.

The popular software by Apple, Logic Pro X, 2002-2017 is an example of a computer-based audio data compositing system, and more specifically the fabrication of composite audio data from source audio data.

U.S. Pat. No. 6,255,576 to Suzuki, Sakama and Tamura discloses a device and method for forming waveform based on a combination of unit waveforms including loop waveform segments, known in the art as a "sampler." Now in the modern era any computer is capable of implementing the rudimentary function of a sampler. This technique is called "sampling." dates back to the origins of electronic music, and is effective in enabling artists to create very novel music due to the reassembly of sound, much the way that multiple sounds can be heard at once by the human ear.

U.S. Pat. No. 6,011,212 to Rigopulos and Egozy discloses a system wherein the user is expected to have a low level of skill in music, yet still be capable of creating music with the system. The method requires that skilled musicians create and embed content within an apparatus ahead of its use, such that an operator can use the apparatus to create music according to particular musical generation procedures.

U.S. Pat. No. 8,487,176 to Wieder discloses a music and sound that varies from one playback to another playback.

U.S. Pat. No. 6,230,140 to Severson and Quinn discloses a continuous sound by concatenating selected digital sound segments.

U.S. Pat. No. 9,304,988 to Terrell, Mansbridge, Reiss and De Man discloses a system and method for performing automatic audio production using semantic data.

U.S. Pat. No. 8,357,847 to Huet, Ulrich and Babinet discloses a method and device for the automatic or semi-automatic composition of multimedia sequence.

U.S. Pat. No. 8,022,287 to Yamashita, Miajima, Takai, Sako, Terauchi, Sasaki and Sakai discloses a music composition data reconstruction device, music composition data reconstruction method, music content reproduction device, and music content reproduction method. U.S. Pat. No. 5,736,663 to Aoki and Sugiura discloses a method and device for automatic music composition employing music template information.

U.S. Pat. No. 7,034,217 to Pachet discloses an automatic music continuation method and device. Pachet is vague, based upon hypothetical advances in machine learning, and certainly makes no disclosure of a system for the enumeration of music.

U.S. Pat. No. 5,726,909 to Krikorian discloses a continuous play background music system.

U.S. Pat. No. 8,819,126 to Krikorian and McCluskey discloses a distributed control for a continuous play background music system.

SUMMARY OF THE DISCLOSED TECHNOLOGY

In one embodiment of the disclosed technology, a Digital Audio Workstation (DAW) is disclosed. Said workstation, in embodiments, receives input comprising a library of musical content provided by artists specializing in the employment of the disclosed technology. The traditional static record is played only from beginning to end, in a finite manner. This has been rendered moot by said library of dynamic content, which is intended to permutate endlessly, without ever repeating the same musical output. A library is a collection of sequences and instruments. Sequences are partial musical compositions, while instruments are groups of audio samples. Instruments further comprise audio data and musical data describing said audio data. The disclosed technology is a system by which radically a unique musical audio composition can be generated autonomously, using parts created by musicians.

The disclosed technology accordingly comprises a system of information models, the several steps for the implementation of these models and the relation of one or more of such steps to each of the others, and the apparatus embodying features of construction, combinations of elements and arrangement of parts that are adapted to effect such steps. All of those are exemplified in the following detailed disclosure, and the scope of the disclosed technology will be indicated in the claims.

The present disclosed technology comprises a system for generation of a musical audio composition, generally comprising a source library of musical content provided by artists, and an autonomous implementation of the disclosed process. The process begins by reading the library provided by the operator. A new chain is created. A succession of macro-sequences are selected, the patterns of which determine the selection of a series of main-sequences, the patterns of which determine the selection of a series of segments in the chain. Detail-sequences are selected for each segment according to matching characteristics. Segment chords are computed based on the main-sequence chords. For all of the main-sequence voices, groups of audio samples and associated metadata are selected by their descriptions. Algorithms determine the final arrangements and exact modulations of source audio to target outputs. Said source audio are modulated, mixed and output as a stream of audio data. Finally the selections and events of the finished segment are output as metadata. An unlimited number of segments can be fabricated in series, each building and evolving from the preceding segments in the chain. The audio signal can be audibly reproduced locally and/or transmitted to a plurality of locations to be audibly reproduced, live-streaming or repeated in the future.

BRIEF DESCRIPTION OF THE DRAWINGS

FIG. 8 shows an example of content created by artists, specifically, macro-type sequences to establish overall musical possibilities.

FIG. 9 shows an example of content created by artists, specifically, main-type sequences to establish harmonic and melodic musical possibilities.

FIG. 10 shows an example of content created by artists, specifically, rhythm-type sequences to establish rhythmic musical possibilities.

FIG. 11 shows an example of content created by artists, specifically, harmonic-type instruments to establish harmonic audio possibilities.

FIG. 12 shows an example of content created by artists, specifically, melodic-type instruments to establish melodic audio possibilities.

FIG. 13 shows an example of content created by artists, specifically, percussive-type instruments to establish percussive audio possibilities.

FIG. 14 shows an example of a generated musical composition persisted as a chain comprised of segments.

DETAILED DESCRIPTION OF EMBODIMENTS OF THE DISCLOSED TECHNOLOGY

Figure 1:
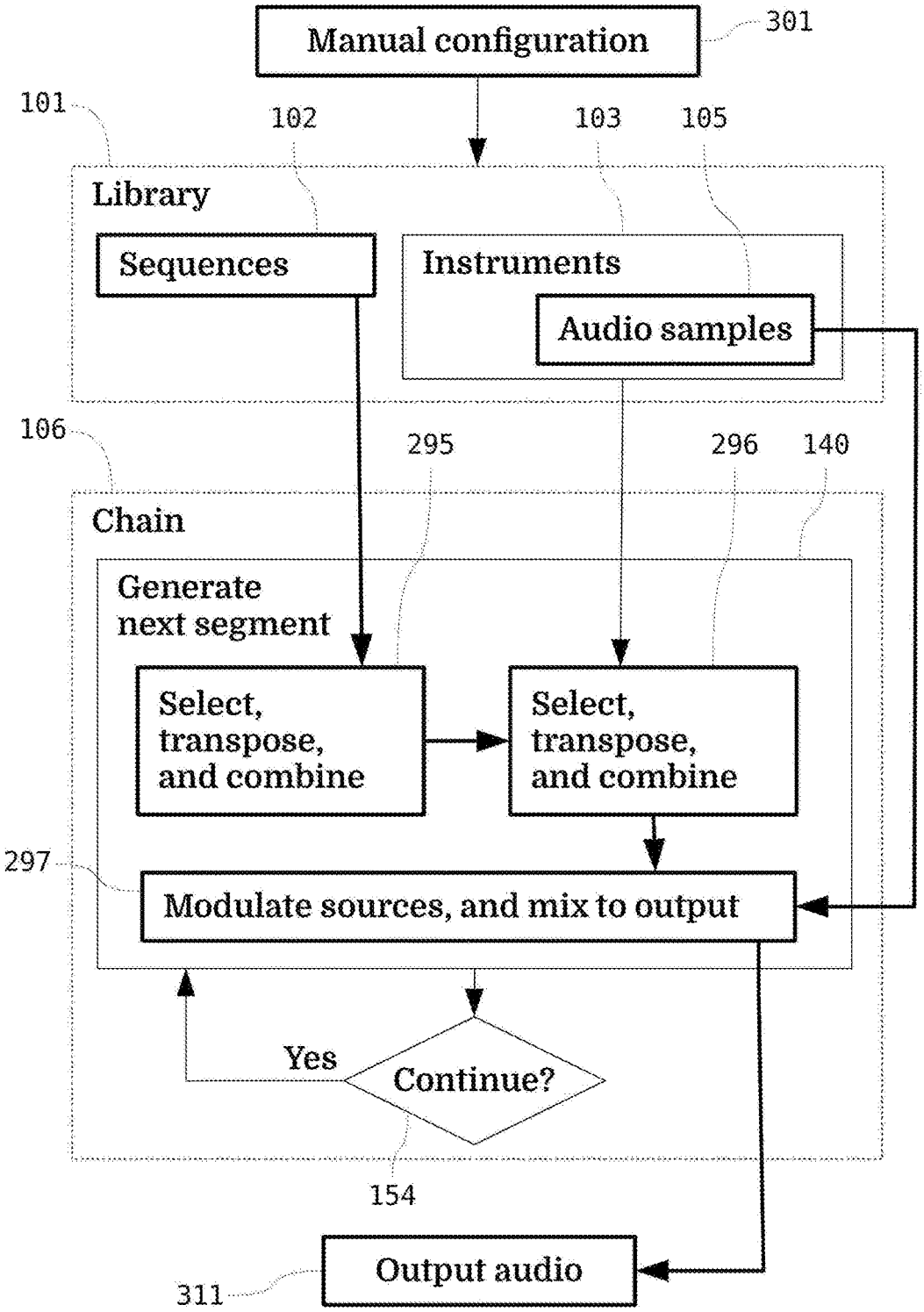
FIG. 1 shows a diagram of the environment in which the disclosed technology operates and generally the overall purpose and functionality of the system.

The terminology used herein is for the purpose of describing particular embodiments only and is not intended to be limiting of the disclosed technology. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which the disclosed technology belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the disclosed technology, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the disclosed technology and the claims.

A new musical audio composition generation system is discussed herein. In the following description, for purposes of explanation, numerous specific details are set forth in order to provide a thorough understanding of the disclosed technology. It will be evident, however, to one skilled in the art that the disclosed technology may be practiced without these specific details.

The present disclosure is to be considered as an exemplification of the disclosed technology, and is not intended to limit the disclosed technology to the specific embodiments illustrated by the figures or description below.

A plurality of audio can be composited ("mixed") into a singular audio. Audio may be locally audible, or a synchronized plurality of audio may be transmitted to a plurality of remote locations to become audible.

Extend that all claims of the disclosed technology, while described entirely in the paradigm of standard Western popular 12-tone music, are applicable to other paradigms of tonal music, such as Harry Partch's 43-tone paradigm as proposed in Partch, Genesis of a Music, 1974 (2nd edition), 1947.

Human-created aleatoric partial compositions are relied upon for the perpetual uniqueness of the system. The contents of sequences are highly subject to transposition. All voices in sequences will have all their exact note choices subject to modification enforced by the chords specified in the macro- and main-type sequences selected for the segment. Patterns of rhythm- and detail-type compositions are generally smaller in length than the patterns of main compositions, and will be repeated multiple times within the segment they are selected for.

The present disclosed technology describes various types of sequences to encompass the vast realm of possibilities that musical artists might create. Actual embodiments of the present disclosed technology may elect to implement a different taxonomy of sequences. The present disclosed technology pertains to all possible permutations of the use of sequences regardless of name. Library sequence examples presented in the drawings are deliberately restricted to the most basic possible implementation of the present disclosed technology. However, the present disclosed technology pertains to any manner of musical composition structure and naming convention.

The present disclosed technology pertains to any combination of voices within sequences, including percussion, harmonic and melodic. The drawings have been restricted to the most basic possible use case, but it is the object of the present disclosed technology to enable musical artists to push the boundary ever further by the complexity of creative expression.

The examples depict melodic, harmonic, and percussive content as separate "layers" of the final resulting audio; the final resulting audio is the sum of all these layers; medias use various combinations of notes and inflections to convey musical effect; the present disclosed technology comprises a composition-media coupling that pertains to any implementation of a musical event, for example lyrical content wherein the inflection is verbal, or any other variation conceived by artists making use of the present disclosed technology.

Subsequent depiction and description of example data are abbreviated for simplicity in service of grasping the overall system and method; all example data are to be understood as incomplete for the purpose of illuminating particular details.

The present disclosed technology will now be described by referencing the appended figures representing preferred embodiments.

"Composition" is defined as an artistic musical production showing study and care in arrangement. The act of composition is the process of forming a whole or integral, by placing together and uniting different parts.

"Artist" or "musician" is defined as skilled practitioner in the art of composition and/or performance of music.

"Engineer" is defined as a person skilled in the principles and practice of music technology, including but not limited to audio engineering, and the operation of musical generation systems.

"Digital Audio Workstation (DAW)" is defined as an electronic device or software application used for recording, editing and producing audio files.

"Audio signal," "audio data," "audio sample," "signal," "audio," or "sample" is defined as information that represents audible sound, such as a digital recording of a musical performance, persisted in a file on a computer.

"Generation" is defined as a process by which data is created, including but not limited to recording the output of a microphone or performing complex mathematical operations.

"Modulation" is defined as a process by which data is modified in such a manner as to alter at least some property, including but not limited to the amplitude, frequency, phase, or intensity of an audible signal.

"Configuration" or "config" is defined as the arrangement or set-up of the hardware and software that make up a computer system.

"Audio channel," "audio track," "track," or "channel" is defined as a single stream of audio data. Optionally, two or more channels may be played together in a synchronized group. For example, stereo output is comprised of a left channel and a right channel.

"Audio composition," "audio mixing," or "mixing" is defined as the process of forming new audio by placing together and uniting at least two source audio samples or channels. In the process, each source audio sample may be modulated such as to best fit within the composition of the final audio output.

"Audio mixer" or "mixer" is defined as an apparatus used to perform audio mixing.

"Audio event" is defined as an event which occurs at a specific position in time within a piece of recorded audio.

"Metadata" is defined as information describing musical properties, including but not limited to events, selections, notes, chords, or the arrangement of audio samples.

"Series" is defined as at least two items succeeding in order.

"Next" is defined as being nearest in time, or adjoining in a series. In an empty series, the next item would be the initial item added to the series.

"Terminus" is defined as either the initial or final item in a series.

"Static" is defined as having a permanently constant nature.

"Dynamic" is defined as having a changing or evolving nature.

"Permutation" is defined as the arrangement of any determinate number of things, in all possible orders, one after the other.

"Note" is defined as a musical sound, a tone, an utterance, or a tune. It may refer either to a single sound or its representation in notation.

"Pitch" is defined as the frequency of vibrations, as in a musical note. The exact pitch of notes has varied over time, and now differs between continents and orchestras.

"Interval" is defined as the distance in pitch between two notes. The violin, for example, is tuned in intervals of a fifth (G to D, D to A and A to E), the double bass in fourths (E to A, A to D and D to G).

"Harmonic intervals" are defined as the distance between two notes which occur simultaneously, as when a violinist tunes the instrument, listening carefully to the sound of two adjacent strings played together.

"Melodic intervals" are defined as the distance between two notes played in series, one after the other.

"Chord" is defined as at least two notes played simultaneously at harmonic intervals.

"Scale" is defined as at least two notes played in series at melodic intervals.

"Musical event" is defined as an action having been, or intended to be performed by a musical instrument, beginning at a specific moment in time, continuing for some amount of time, having characteristics including but not limited to chord, pitch, or velocity.

"Harmonic event" is defined as a single occurrence of an action having been, or intended to be performed by a harmonic instrument.

"Melodic event" is defined as a single occurrence of an action having been, or intended to be performed by a melodic instrument.

"Harmonic progression" is defined as the placement of chords with relation to each other such as to be musically correct and emotionally evocative.

"Key," "root key," or "key signature" is defined as the aspect of a musical composition indicating the scale to be used, and the key-note or home-note. Generally, a musical composition ends—evoking resolve—on the chord matching its key. The key of a musical composition determines a context within which its harmonic progression will be effective.

"Voice" is defined as a single identity within a musical composition, such as might be performed by a single musical instrument. A voice is either percussive, harmonic, or melodic.

"Voice event" is defined as a single occurrence of an action having been, or intended to be performed by a single voice of a musical composition. An event has musical characteristics, representing a particular note or chord.

"Song" is defined as a musical composition having a beginning, a middle, and an end.

"Section" is defined as a distinct portion of a musical composition.

"Partial musical composition" or "part" is defined as a subset of a complete musical composition, such as to be interchangeable with other subsets of other compositions.

"Composite music" is defined as a work of musical art created dynamically from distinct parts or elements, distinguished from traditional recorded music, which is mastered and finished statically as a deliverable record.

"Aleatoric" music, or music composed "aleatorically," is defined as music in which some element of the composition is left to chance, and/or some primary element of a composed work's realization is left to the determination of its performer(s).

"Sequence," "musical sequence," or "main sequence" is defined as a partial musical composition comprising or consisting of a progression of chords and corresponding musical events output of said related thereto and/or represented by stored musical notations for the playback of instruments. A sequence is comprised of at least some section representing a progression of musical variation within the sequence.

"Composite musical sequence" is defined as an integral whole musical composition comprised of distinct partial musical sequences.

"Macro-sequence" is defined as a partial musical composition comprising or consisting of instructions for the selection of a series of at least one main sequence, and the selection of exactly one following macro-sequence.

"Rhythm sequence" is defined as a partial musical composition comprising or consisting of solely percussive instruments and output of said related thereto and/or represented by stored musical notations for the playback of percussive instruments.

"Detail sequence" is defined as the most atomic and portable sort of partial musical composition, and is intended to be utilized wherever its musical characteristics are deemed fit.

"Instrument" is defined as a collection comprising or consisting of audio samples and corresponding musical notation related thereto and/or represented by stored audio data for playback.

"Library" is defined as collection consisting or comprising of both sequences and instruments, embodying a complete artistic work, being musical composition which is intended by the artist to be performed autonomously and indefinitely without repetition, by way of the the present disclosed technology.

"Chain" is defined as an information schema representing a musical composite. "Segment" is defined as an information schema representing a partial section of a chain. A chain comprises a series of at least one segment.

"Meme" is defined as the most atomic possible unit of meaning. Artists assign groups of memes to instruments, sequences, and the sections therein. During fabrication, entities having shared memes will be considered complementary.

"Choice" is defined as a decision to employ a particular sequence or instrument in a segment.

"Arrangement" is defined as the exact way that an instrument will fulfill the musical characteristics specified by a sequence. This includes the choice of particular audio samples, and modulation of those audio samples to match target musical characteristics.

"Node" is a term commonly used in the mathematical field of graph theory, defined as a single point.

"Edge" is a term commonly used in the mathematical field of graph theory, defined as a connection between two nodes.

"Morph" is defined as a particular arrangement, expressed as nodes and edges, of audio samples to fulfill the voice events specified by a sequence.

"Sub-morph" is defined as a possible subset of the events in a morph.

"Isometric" is a term commonly used in the mathematical field of graph theory, defined by pertaining to, or characterized by, equality of measure. Set A and Set B are isometric when graph theoretical analysis finds similar measurements betwixt the items therein.

"Audio event sub-morph isometry" is defined as the measurement of equality between all sub-morphs possible given a source and target set of audio events.

"Time-fixed pitch-shift" is defined as a well-known technique used either to alter the pitch of a portion of recorded audio data without disturbing its timing, or conversely to alter its timing without disturbing the pitch.

"Artificial Intelligence (AI)" is defined as the theory and development of computer systems able to perform tasks that normally require human intelligence, such as visual perception, speech recognition, decision-making, and music generation.

FIG. 1 shows a diagram of the environment in which an embodiment of the disclosed technology operates. Artists manually configure the system 301 and provide input comprising a library 101, further comprising sequences 102 and instruments 103, wherein instruments are further comprised of audio samples 105. The fabrication process is persisted as a chain 106, within which are generated a series of segments. In order to generate each next segment 140, sequences are selected, transposed, and combined into a composite sequence 295. Instruments are selected, transposed according to the musical characteristics of said composite sequence, and combined 296. Selected source audio samples are modulated and mixed into final output audio 297, resulting in the output audio data 311. For as long as the process is intended to continue 154, more segments will be generated in series.

In FIG. 1, manual configuration 301 comprises artists and engineers using any type of personal information technological device, connected by any type of telecommunications network to any type of centralized technological platform, wherein the present disclosed technology is implemented. Artists manually configure a library of content within the central platform. Engineers operate the central platform in order to create a new chain. Once the fabrication process has begun, segments will be autonomously fabricated, and audio output shipped by any means, with minimal supervision.

Having described the environment in which the disclosed technology operates and generally the overall purpose and functionality of the system, the following is a more detailed description of the disclosed technology and embodiments thereof.

Figure 2:
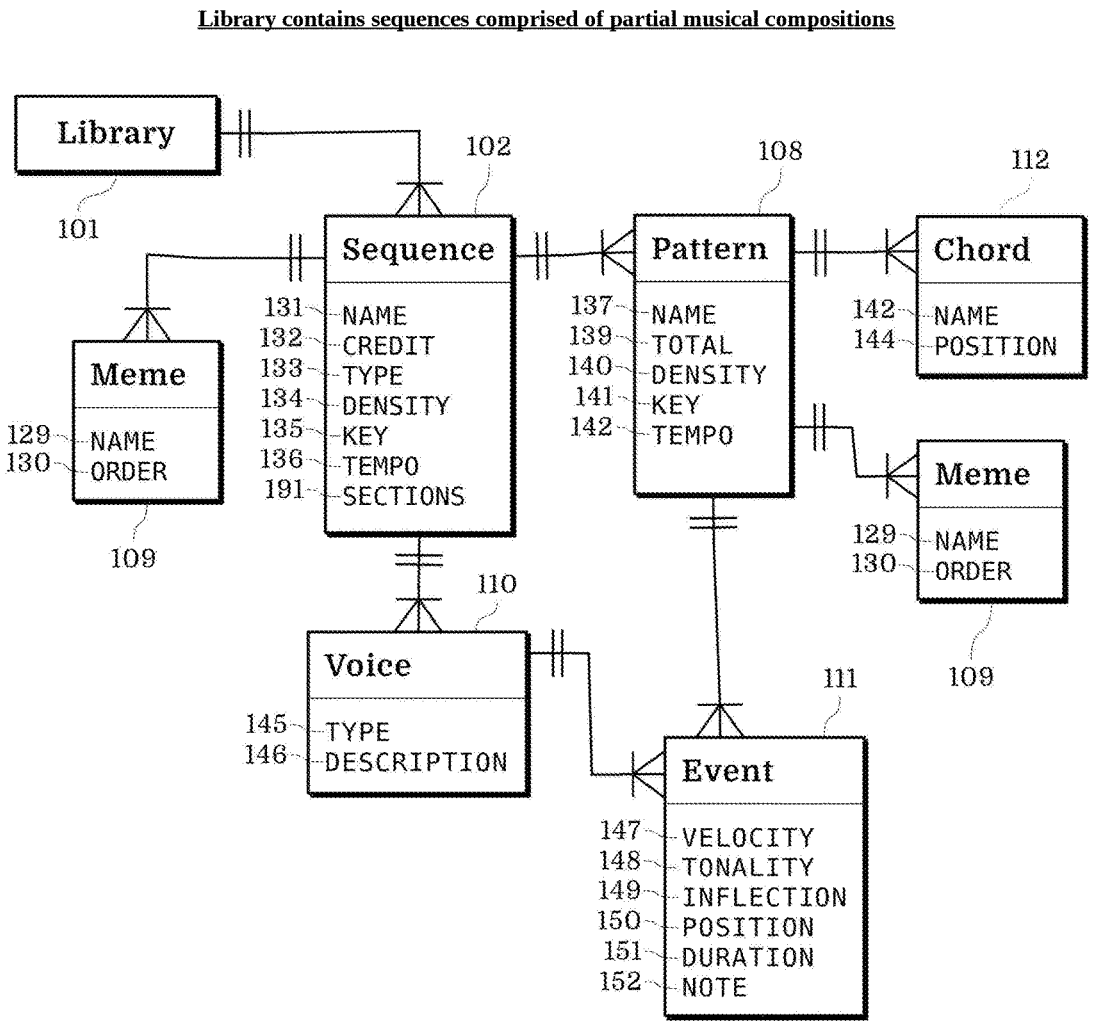
FIG. 2 show an information schema to persist a library which contains sequences comprised of partial musical compositions.

FIG. 2 depicts an entity relation diagram of an exemplary model of a preferred embodiment of a library 101 containing at least one sequence 102. Each sequence has

- name 131 identifying it within the library, e.g. "All of Me,"
- credit 132 securing royalties for the artist responsible for the creation of each sequence, e.g. "Simons & Marks,"
- type 133 classifying the sequence as either a Macro-sequence, Main-sequence, Rhythm-sequence, or Detail-sequence,
- density 134 specifying what ratio of the total available soundscape each composition is intended to fill, e.g "0" (silence), "0.12" (quiet), "0.84" (engine room) or "0.97" (explosion),
- key 135 having root and mode, e.g. "C Major," tempo 136 specifying beats per minute, e.g. "128 BPM," and
- sections 191 specifying an aleatoric order within which to play the patterns of a sequence in order to perform a complete musical composition, e.g. "Intro Vamp Chorus Breakdown Bridge." Sections express the contents of N number of consecutive segments, having N different patterns in a repeatable order: "0, 1, 2, 3," or "A, B, C, D," or however the patterns are named for any given sequence. If there are multiple patterns provided in the sequence with a similar name, one will be played per unique section, selected at random from all candidates.

In FIG. 2, a sequence 102 has at least one pattern 108. Each pattern has

- name 137 identifying it in the sequence, e.g. "Breakdown," or "Bridge,"
- total 139 specifying a count of all the beats in a section, e.g. "64,"
- density 140 specifying what ratio of the total available soundscape each composition is intended to fill, e.g "0" (silence), "0.12" (quiet), "0.84" (engine room) or "0.97" (explosion),
- key 141 specifying root and mode, e.g. "C Major," and a tempo 142 specifying beats per minute, e.g. "128 BPM."

In FIG. 2, each sequence 102 optionally has one or more voice 110 to embody each particular musical voice, e.g. "Melody," or "Bassline." Each voice has

- type 145 classifying it as a Percussive-voice, Harmonic-voice, Melodic-voice, or Vocal-voice, and
- description 146 specifying text used to compare candidate instruments to fulfill voices (which also have a description), e.g. "angelic," or "pans."

In FIG. 2, each voice 110 optionally has one or more event 111 specifying one or more of time, note, or inflection within the musical composition. Each voice event has

- velocity 147 specifying the ratio of impact of each event, e.g. "0.05" (very quiet) or "0.94" (very loud),
- tonality 148 specifying the ratio of tone (consistent vibrations, as opposed to chaotic versus chaos) of each event, e.g. "0.015" (a crash cymbal) or "0.96" (a flute),
- inflection 149 specifying text used to compare candidate audio samples to fulfill any given event, e.g. "Staccato" (piano), "Kick" (drum) or "Bam" (vocal),
- position 150 specifying the location of the event in terms of beats after pattern start, e.g. "4.25" or "−0.75" (lead in),
- duration 151 specifying the number of beats for which to sustain the event, e.g. "0.5" (an eighth note in a 4/4 meter), and note 152 specifying the pitch class, e.g. "C#."

In FIG. 2, each sequence 102 has at least some meme 109 for the purpose of categorizing sequences, comprising a subset of the collective memes present in said library. Further, each pattern 108 may lack memes entirely, or may have at least one meme 109. Memes are intended as a tool of utmost pliability in the hands of a musical artist, thus, entities that share a Meme are considered to be related. Each meme has

- name 129 which is to be interpreted in terms of its similarity in dictionary meaning to the names of other memes, e.g., "Melancholy," and
- order 130, indicating the priority of a Meme in terms of importance relative to other memes attached to this sequence, e.g. "0" (First), "1" (Second), or "2" (Third).

In FIG. 2, each sequence pattern 108 optionally has one or more chord 112 naming a harmonic set of three or more notes that are heard as if sounding simultaneously. Each chord has

- name 143 specifying root and form, e.g. "G minor 7,"
- position 144 specifying the location of the chord in the pattern, in terms of beats after section start, e.g. "4.25."

Figure 3:
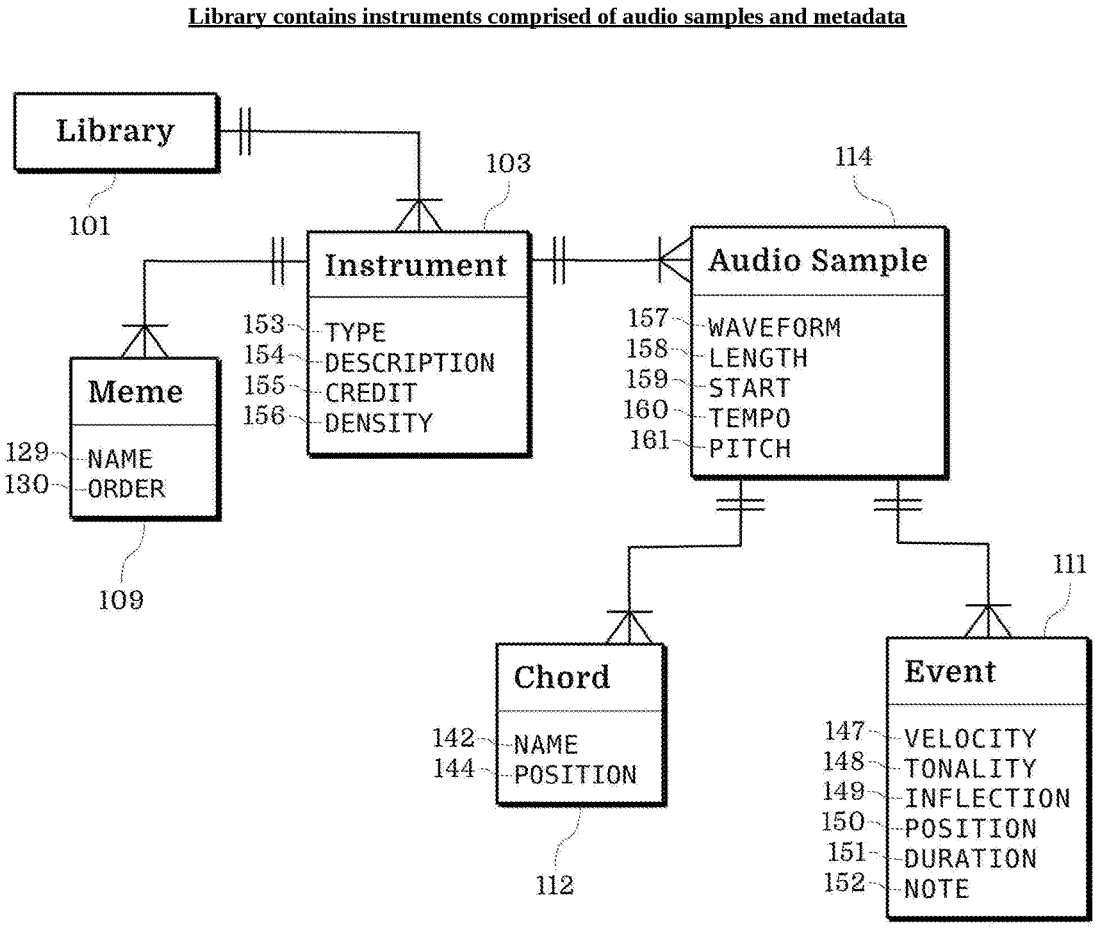
FIG. 3 show an information schema to persist a library which contains instruments comprised of audio samples and metadata.

FIG. 3 depicts an entity relation diagram of an exemplary model of a preferred embodiment of a library 101 containing at least one instrument 103. Each instrument has

- type 153 classifying the instrument as either a Percussive-instrument, Harmonic-instrument, or Melodic-instrument,
- description 154 specifying text used to compare instruments as candidates to fulfill voices (which also have description), e.g. "angelic" or "pots & pans,"
- credit 155 ensuring royalties to the artist responsible for creating the instrument, e.g. "Roland Corporation," and
- density 156 specifying what ratio of the total available soundscape each instrument is intended to fill, e.g "0" (silence), "0.12" (quiet), "0.84" (engine room) or "0.97" (explosion).

In FIG. 3, each instrument 103 has at least one meme 109. Each meme has a name 129, and a description 130.

In FIG. 3, each instrument 103 has at least one audio sample 114. Each audio sample has

- waveform 157 containing data representing audio sampled at a known rate, e.g. binary data comprising stereo PCM 64-bit floating point audio sampled at 48 kHz,
- length 158 specifying the number of seconds of the duration of the audio waveform, e.g. "10.73 seconds,"
- start 159 specifying the number of seconds of preamble after start before the waveform is considered to have its moment of initial impact, e.g. "0.0275 seconds" (very close to the beginning of the waveform),
- tempo 160 specifying beats per minute of performance sampled in waveform, e.g. "105.36 BPM," and
- pitch 161 specifying root pitch in Hz of performance sampled in waveform, e.g. "2037 Hz."

In FIG. 3, each audio sample 114 has at least one event 111. Each event has velocity 147, tonality 148, inflection 149, position 150, duration 151, and note 152. Media item Event has Event Tonality 148. Media item Event has Event Inflection 149. Media item Event has Event Position 150. Media item Event has Event Duration 151. Media item Event has Event Note 152.

In FIG. 3, each audio sample optionally has one or more chord 112. Each chord has name 142, and position 144.

In FIG. 3, audio pitch 161 is measured in Hertz, notated as Hz, e.g. 432 Hz, being the mean dominant pitch used for math transmogrifying source audio to final playback audio. A waveform 157 may contain a rendering of a plurality of musical events, in which case there will also exist a plurality of audio event 111. Playback of such a full performance will be time-fixed pitch-shifted to the target key based on the root pitch Hz, which is presumably the key in which the music has been performed in the original audio recording.

Figure 4:
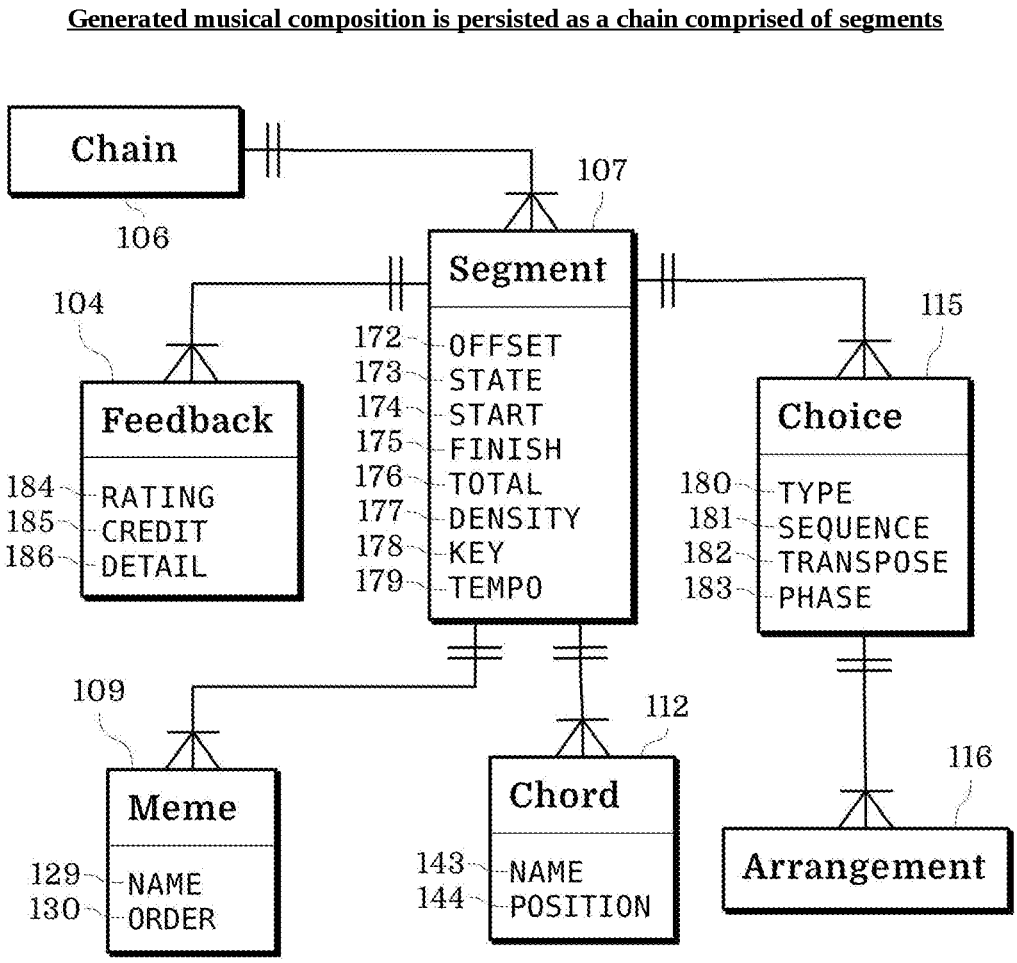
FIG. 4 shows an information schema to persist a generated musical composition as a chain comprised of segments.

The entity relation diagram depicted in FIG. 4 shows an exemplary preferred embodiment of a chain 106 comprised of one or more segments 107. Each segment has

- offset 172 enumerating a series of segments in the chain, wherein each segment offset is incremented in chronological order, e.g. "0" (first), "1" (second),
- state 173 specifying the state of current segment, for engineering purposes, to be used by an apparatus to keep track of the various states of progress of fabrication of segments in the chain,
- start 174 specifying the number of seconds which the start of this segment is located relative to the start of the chain, e.g. "110.82 seconds,"
- finish 175 specifying the number of seconds which the end of this Segment is located relative to the the start of the Chain, e.g. "143.16 seconds,"
- total 176 specifying the count of all beats in the segment from start to finish, e.g. "16 beats" (4 measures at 4/4 meter),
- density 177 specifying what ratio of the total available soundscape each segment is intended to fill, e.g "0" (silence), "0.12" (quiet), "0.84" (engine room) or "0.97" (explosion),
- key 178 specifying the root note and mode, e.g. "F major," and
- tempo 179 specifying the target beats per minute for this Segment, e.g. "128 BPM."

In FIG. 4, each segment 107 has tempo 179 measuring the exact beats-per-minute velocity of the audio rendered at the end of the segment. However, if the preceding segment has a different tempo, the actual velocity of audio will computed by integral calculus, in order to smoothly increase or decrease the segment's tempo and achieve target velocity exactly at the end of that segment.

In FIG. 4, each segment 107 has at least one meme 109. Each meme has name 129, and order 130.

In FIG. 4, each segment 107 has at least one chord 112. Each chord has name 143, and position 144.

In FIG. 4, each segment 107 has at least one choice 115 determining the use of a particular sequence for that segment. Each choice has

- type 180 classifying the Choice as either Macro-choice, Main-choice, Rhythm-choice, or Detail-choice,
- sequence 181 referencing a sequence in the library,
- transpose 182 specifying how many semitones to transpose this sequence into its actual use in this segment, e.g. "−3 semitones" or "+5 semitones,"
- phase 183 enumerating the succeeding segments in which a single sequence has its multiple patterns selected according to its sections, and
- at least one arrangement 116 determining the use of a particular instrument and the modulation of its particular audio samples to be isometric to this choice.

In FIG. 4, each choice 115 determines via its phase 183 whether to continue to the next section of a sequence that was selected for the immediately preceding segment. If so, its phase will be increased from the phase of the choice of that sequence in the immediately preceding segment. For example, if a new sequence is selected, one that has not been selected for the segment immediately preceding this segment, then the phase of that choice is 0. However, if a choice has a phase of 0 for segment at offset 3, then the same sequence selected will have a phase of 1 for segment at offset 4, or a phase of 2 for segment at offset 5.

In FIG. 4, each segment 107 optionally has one or more feedback 104 enabling the implementation of machine learning in order to enhance the performance of the system based on feedback from listeners. Each segment feedback has

- rating 185 measuring the ratio of achievement of target, a value between 0 and 1,
- credit 184 connecting this feedback to a particular listener responsible for contributing the feedback, e.g. "User 974634723,"
- detail 186 adding any further structured or unstructured information about this particular listener's response to this segment.

Figure 5:
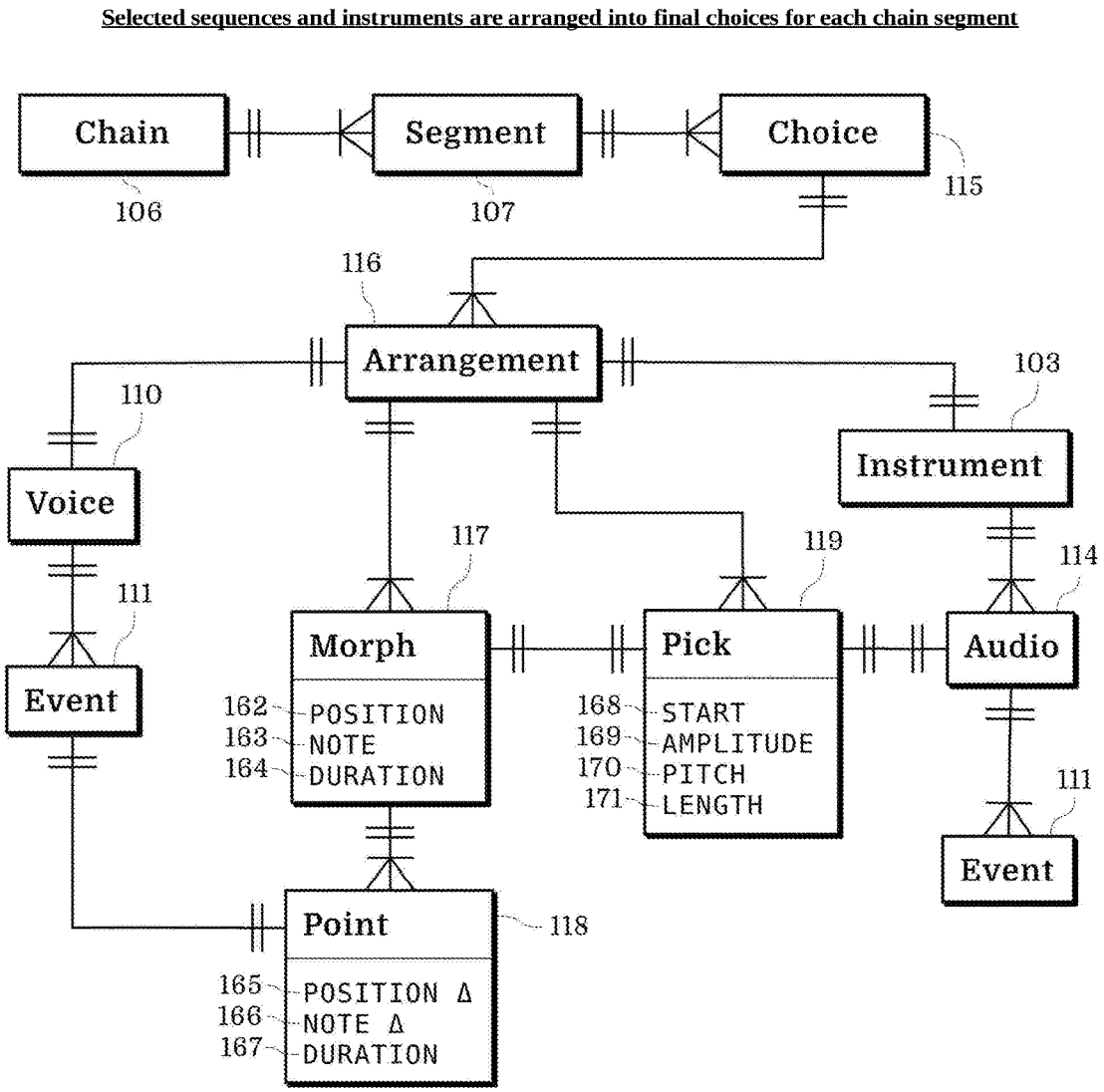
FIG. 5 shows an information schema to persist selected sequences and instruments arranged into final choices for each chain segment.

The entity relation diagram depicted in FIG. 5 shows an exemplary preferred embodiment of an arrangement 116. A chain 106 has at least one segment 107 which has at least one choice 115 which has at least one arrangement 116. Each arrangement references a single voice 110. Each arrangement references a single instrument 103.

In FIG. 5, each arrangement voice 110 has at least one event 111. Each arrangement instrument 103 has at least one audio sample 114, comprised of at least one event 111.

In FIG. 5, each arrangement has at least one morph 117 enumerating all possible subgraphs of musical events, an information structure used in the determination of audio sample modulation. Each morph has

- position 162 specifying the location of this morph in terms of beats relative to the beginning of the segment, e.g. "0 beats" (at the top), "−0.5 beats" (lead-in), or "4 beats,"
- note 163 specifying the number of semitones distance from this pitch class at the beginning of this morph from the key of the parent segment, e.g. "+5 semitones" or "−3 semitones,"
- duration 164 specifying the sum timespan of the points of this morph in terms of beats, e.g. "4 beats."

In FIG. 5, each morph 117 has at least one point 118 specifying a particular feature in time and tone relative to the root of a morph. Each morph point has

- position Δ 165 specifying location in beats relative to the beginning of the morph, e.g. "4 beats," or "−1 beat" (quarter note lead-in in 4/4 meter),
- note Δ 166 specifying how many semitones pitch class distance from this point to the top of the parent morph, e.g. "−2 semitones" or "+4 semitones,"
- duration 167 specifying how many beats this point spans, e.g. "3 beats."

In FIG. 5, each arrangement 116 has at least one pick 119 determining the final use of a single atomic piece of recorded audio to fulfill a morph of events in a musical composition in a segment in a chain of an audio composite. Each arrangement pick has

- start 168 specifying the location in seconds offset of this point relative to the start of the parent morph, e.g. "4.72 seconds,"
- amplitude 169 specifying a ratio of loudness, e.g. "0.12" (very quiet), "0.56" (medium volume) or "0.94" (very loud),
- pitch 170 specifying a target pitch for playback of final audio in Hz, e.g. "4273 Hz,"
- length 171 specifying a target length to time-aware-pitch-shift final audio in seconds, e.g. "2.315 seconds."

In FIG. 5, each morph point 118 references a single sequence voice event 111. Each arrangement pick 119 references a single instrument audio sample 114.

Figure 6:
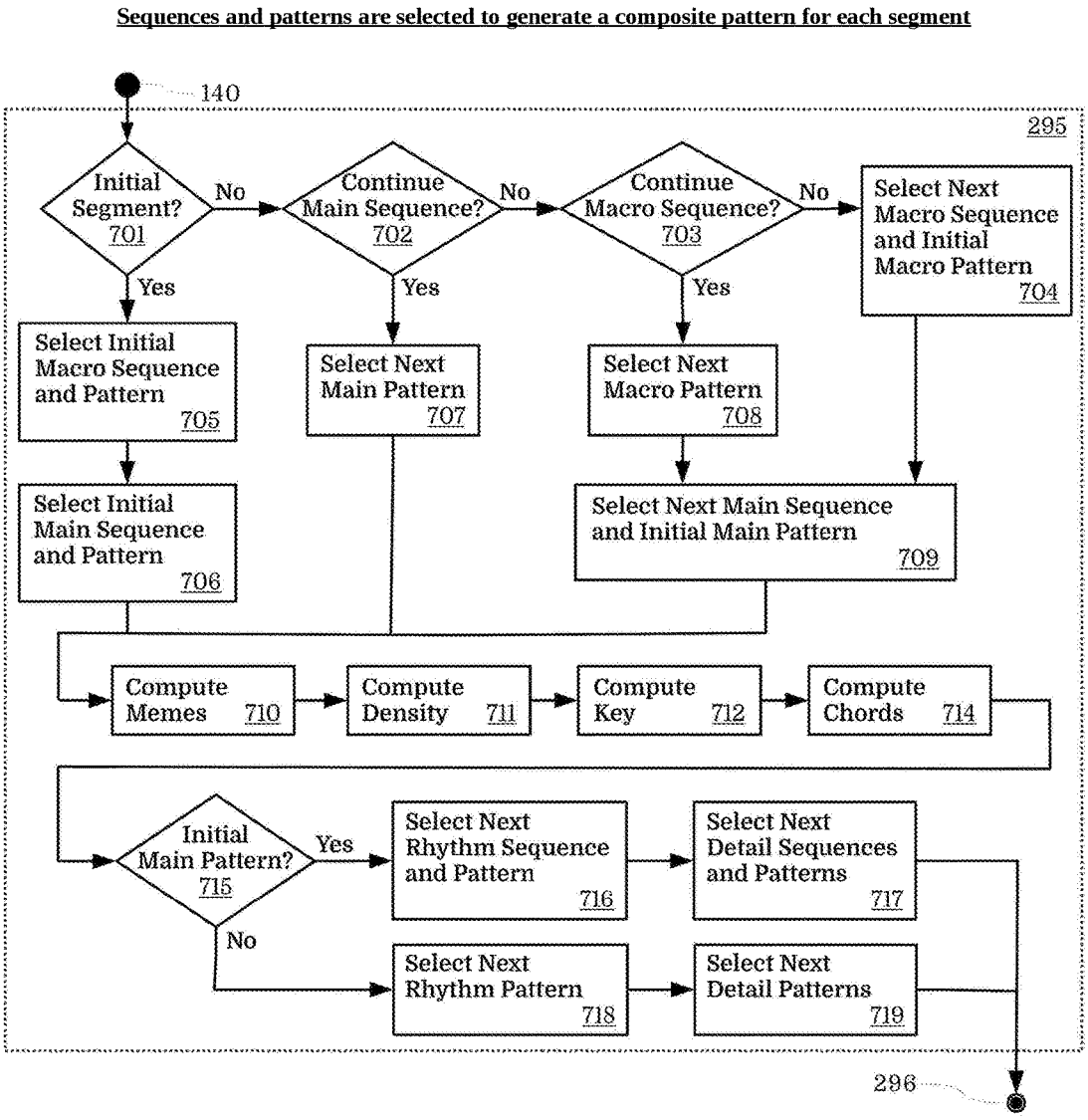
FIG. 6 shows a diagram of the process by which sequences and patterns are selected to generate a composite pattern for each segment.

The flow diagram depicted in FIG. 6 shows an exemplary embodiment of the preferred process by which sequences and patterns are selected to generate a composite pattern for each segment 295. This process is set in motion by the generation 140 of a new segment in a chain.

In FIG. 6, for each segment, it is necessary to select one macro-sequence, and one macro-pattern therein. If this is the initial segment 701, the macro-sequence and initial macro-pattern therein will be selected 705 from the library at random. If this is not the initial segment 701, and the main-sequence selected for the preceding segment will not continue 702, either the macro-sequence will continue from the preceding segment 703 to select its next macro-pattern 708, or the next macro-sequence and its initial macro-pattern will be selected 704. When one macro-sequence succeeds another, the initial selected macro-pattern of the succeeding macro-sequence will replace the use of the final macro-pattern of the preceding macro-sequence, and the succeeding macro-sequence will be transposed upon choice, such that its initial macro-pattern aligns in terms of key pitch class with the final macro-pattern of the preceding selected macro-sequence.

In FIG. 6, for each segment, it is necessary to select one main-sequence, and one main-pattern therein. If this is the initial segment 701, the main-sequence and initial main-pattern therein will be selected 706 from the library according to the selected macro-sequence and macro-pattern. If this is not the initial segment 701, either the main-sequence will continue 702 to select its next main-pattern 707, or the next main-sequence and its initial main-pattern will be selected 709.

In FIG. 6, after the selection of macro- and main-type sequences and patterns, segment properties are computed. Computations are made based on the properties of the selected macro- and main-type sequences and patterns. Memes 710 are copied. Density 711 is averaged. Key 712 is transposed recursively via main-pattern, main-sequence, macro-pattern, and macro-sequence. Chords 714 are transposed from selected main-pattern to target key.

In FIG. 6, after selection of macro- and main-type sequences and patterns and computation of segment properties, rhythm- and detail-type sequences and patterns will be selected. The quantity of detail-sequences to be selected will be determined by the target density computed for the segment. Selection of rhythm- and detail-type sequences will be based on all available computed properties of the segment. If the selected main-sequence has just begun, meaning that the selected main-pattern is its initial 715, then select the next rhythm-sequence and rhythm-pattern 716, and select the next detail-sequence and detail-pattern 719. If the selected main-pattern is not initial 715, the preceding selection of rhythm-sequence will be continued by selecting its next rhythm-pattern, and preceding selections of detail-sequences will be continued by selecting their next detail-patterns. After selection of rhythm- and detail-type sequences and patterns, the process is complete, and ready for instrument selection 296.

Figure 7:
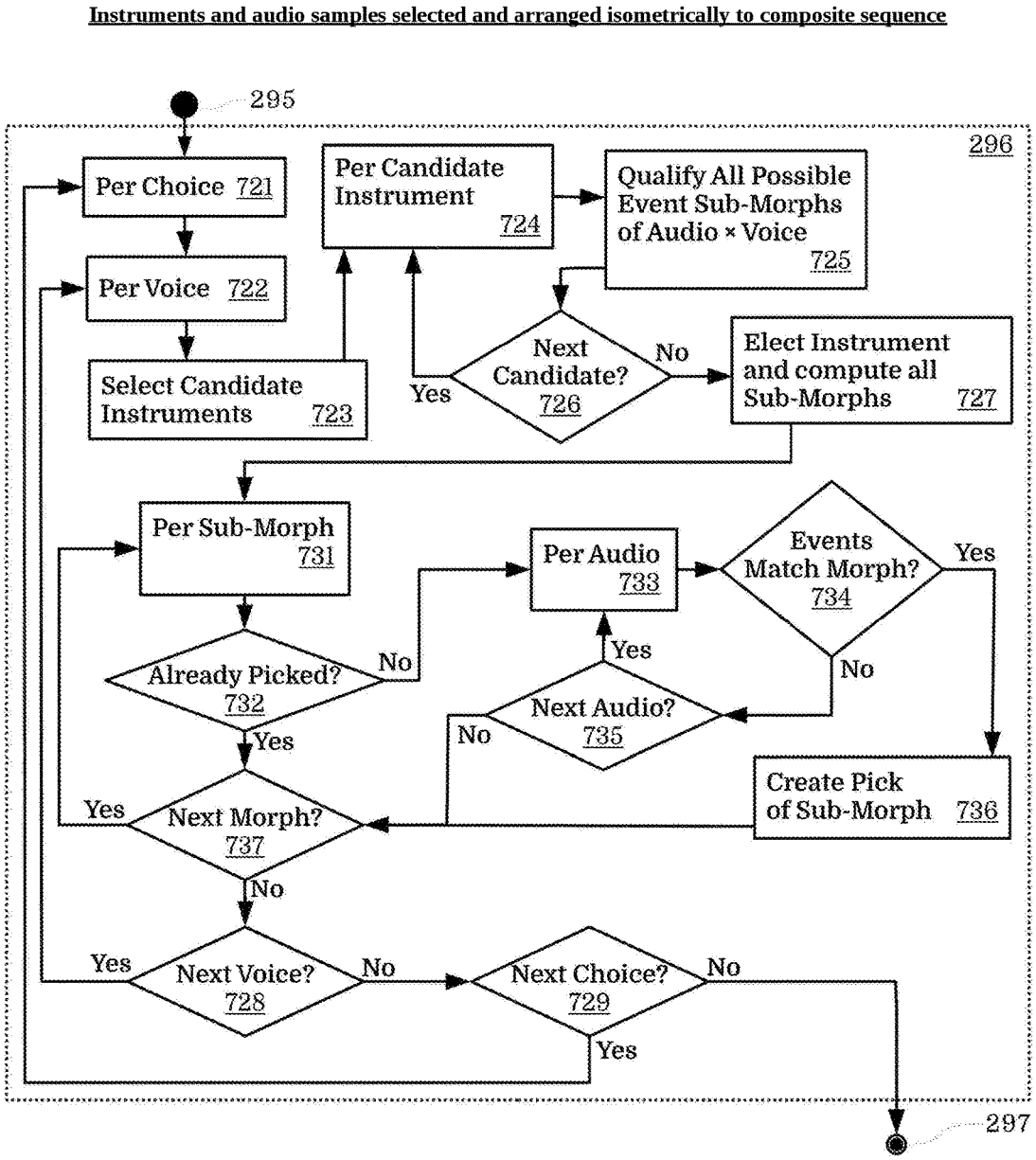
FIG. 7 shows a diagram of the process by which instruments and audio samples selected and arranged isometrically to composite sequence.

The flow diagram depicted in FIG. 7 shows an exemplary embodiment of the preferred process by which instruments and audio samples are selected and arranged isometrically to the composite sequence 296. This process is set in motion by the completion 295 of the process of selecting sequences and computing segment properties.

In FIG. 7, per each choice 721 of sequence of this segment, per each voice 722 in the selected sequence, it will be necessary to select one instrument. This selection is a complex process of comparison of isometry of source and target graphs, where the source is the selected sequences, and the target are all the available instruments in the library. This begins by narrowing all available instruments in the library to only the candidate instruments 723 which could potentially match the selected sequences. Per each candidate instrument 724, all possible event sub-morphs are qualified 725, which results in an overall Q-score representing the extent to which each candidate instrument would most probable to fulfill the implications of the selected sequences. After all candidates have been qualified 726, the final instrument is elected 727 with some random effect from the pool of most-qualified candidates, and all its available sub-morphs are computed in advance of the morph-pick process.

In FIG. 7, per each available sub-morph 731, if it has not already been picked 732, per each available audio 733 within the selected instrument, if all the audio events match the morph, create a pick 736 modulating this audio sample to fulfill this particular sub-morph, until there are no more available audio 735, and no more sub-morphs 737 to fulfill.

In FIG. 7, when there are no further voices 728 and no further choices 729 to fulfill, the instrument and audio sample modulation 296 process is complete, now ready for the final modulation and mix 297 of output audio.

A data table depicted in FIG. 8 shows an example of a macro-sequence 200 which an artist has prepared with the intention of imbuing the music overall with a feeling of grief. The sequence 102 has name 131, credit 132, type 133, and patterns 108 having key 141, density 140 and tempo 142 and memes 109 wherein the meme "joy" at offset 0 followed by "grief" at offset 1 denotes the conceptual movement from joy to grief.

In FIG. 8, a data table shows an example of a macro-sequence 201 which an artist has prepared with the intention of imbuing the music overall with a feeling of joy. The sequence 102 has name 131, credit 132, type 133, and patterns 108 having key 141, density 140 and tempo 142 and memes 109 wherein the meme "grief" at offset 0 followed by "joy" at offset 1 and offset 2 denotes the conceptual movement from grief to joy.

A data table depicted in FIG. 9 shows an example of a main-sequence 203 which an artist has prepared with the intention of conveying a main musical theme of joy and grit. The sequence 102 has name 131, credit 132, type 133, and patterns 108 having key 141, density 140, tempo 142, and meme 109. This main-sequence is an adaptation of Pike and Ordway, Happy Are We Tonight, 1850 and it has memes of joy and grit. When this sequence is selected, the overall musical structure of a series of segments will embody joy and grit.

The data table depicted in FIG. 10 shows an example of a rhythm-sequence 205 which an artist has prepared with the intention of imbuing the rhythmic quality of the music with joy and grit. The sequence 102 has name 131, credit 132, type 133, density 134, key 135, tempo 136, meme 109, and patterns 108. This rhythm-sequence has memes of joy and grit. When selected, the rhythm will embody joy and grit.

The data table depicted in FIG. 11 shows an example of a harmonic-instrument 211 which an artist has prepared with the intention of adding joyful harmonic sounds to the generated audio. The instrument 103 has type 153, description 154, credit 155, meme 109, and audio samples 114. Each of the audio samples has metadata associated, describing musical events recorded by each recorded audio of musical performance. These partial sounds will be selected and modulated to be isometric to a generated composite of musical events.

The data table depicted in FIG. 12 shows an example of a melodic-instrument 212 which an artist has prepared with the intention of adding grieving melodic sounds to the generated audio. The instrument 103 has type 153, description 154, credit 155, meme 109, and audio samples 114. Each of the audio samples has metadata associated, describing musical events recorded by each recorded audio of musical performance. These partial sounds will be selected and modulated to be isometric to a generated composite of musical events.

The data table depicted in FIG. 13 shows an example of a rhythm-instrument 209 which an artist has prepared with the intention of adding joyful and nostalgic percussive sounds to the generated audio. The instrument 103 has type 153, description 154, credit 155, meme 109, and audio samples 114. Each of the audio samples has metadata associated, describing musical events recorded by each recorded audio of musical performance. These partial sounds will be selected and modulated to be isometric to a generated composite of musical events.

The data table depicted in FIG. 14 shows an example of one possible set of composite musical compositions resulting from the autonomous generation of a series of segments based on the content manually input by artists. The chain 106 is comprised of a series of segments. Each segment has offset 172, state 173, start 174, finish 175, total 176, density 177, key 178, and tempo 179. In this example, segment 221 with offset=0, segment 222 with offset=1, segment 223 with offset=2, segment 224 with offset=3, and segment 225 with offset=4.

In FIG. 14, each macro-sequence 215 is the template for selecting and transposing the main-sequence for each segment. Each main-sequence 216 determines the overall musical theme, chords, and melody the segment. Each rhythm-sequence 217 determines the rhythm, comprising the percussive events for the segment. Each segment includes one or more detail sequences 218 to determine additional musical events for the segment.

In FIG. 14, segment 221 at offset=0 is the initial segment in the chain, so the choice of macro-sequence 200 is random. The first section of that grieving macro-sequence has a meme of joy so the main choice is joyful main-sequence 203 transposed −4 semitones to match the key of the first section of the macro-sequence. Rhythm-sequence 205 is transposed +3 semitones to match the key of the transposed main-sequence; finally, detail-sequence 207 is transposed +3 semitones to match the key of the transposed main-sequence.

In FIG. 14, segment 222 at offset=1 bases its selections on those of the preceding segment 221 at offset=0. The macro-sequence 200 continues from the preceding segment. The same main-sequence 203 continues from the preceding segment, which has memes of both joy and grit. The rhythm-sequence 205 from the preceding segment advances to phase=1. Two sequences are selected, one for each meme, detail-sequence 207, and gritty support-sequence 220 transposed +3 semitones to match the key of the transposed main-sequence.

In FIG. 14, segment 223 at offset=2 bases its selections on those of the preceding segment 222 at offset=1. The macro-sequence from the preceding segment advances to its next phase, but because that is its final pattern, and the next macro-sequence 201 is selected yet transposed −5 semitones to match what the final phase of the previous macro-sequence would have been; the main selection is main-sequence 202 transposed +2 semitones to match the key of the transposed macro-sequence, and its first section has the meme loss. The rhythm choice is rhythm-sequence 204 transposed +2 semitones to match the key of the transposed main-sequence. Finally, the detail selection is support-sequence 219 transposed +2 semitones to match the key of the transposed main-sequence.

In FIG. 14, segment 224 at offset=3 bases its choices on those of the preceding segment 223 at offset=2. The macro-sequence 201 continues from the preceding segment. The main-sequence 202 advances to phase=1, which has the meme grief. The rhythm-sequence 204 from the preceding segment advances to phase=1. The detail-sequence 206 transposed +2 semitones to match the key of the transposed main-sequence.

In FIG. 14, segment 225 at offset=4 bases its choices on those of the preceding segment at 224 at offset=3. The macro-sequence 201 advances to phase=1, which has the meme joy. The main-choice is main-sequence 203 which does not need to be transposed because the original sequence coincidentally matches the key of the transposed macro-sequence. The rhythm-sequence 205 from the previous segment transposed −5 semitones to match the key of the main-sequence. The support-sequence 207 transposed +3 semitones to match the key of the main-sequence.

Figure 15:
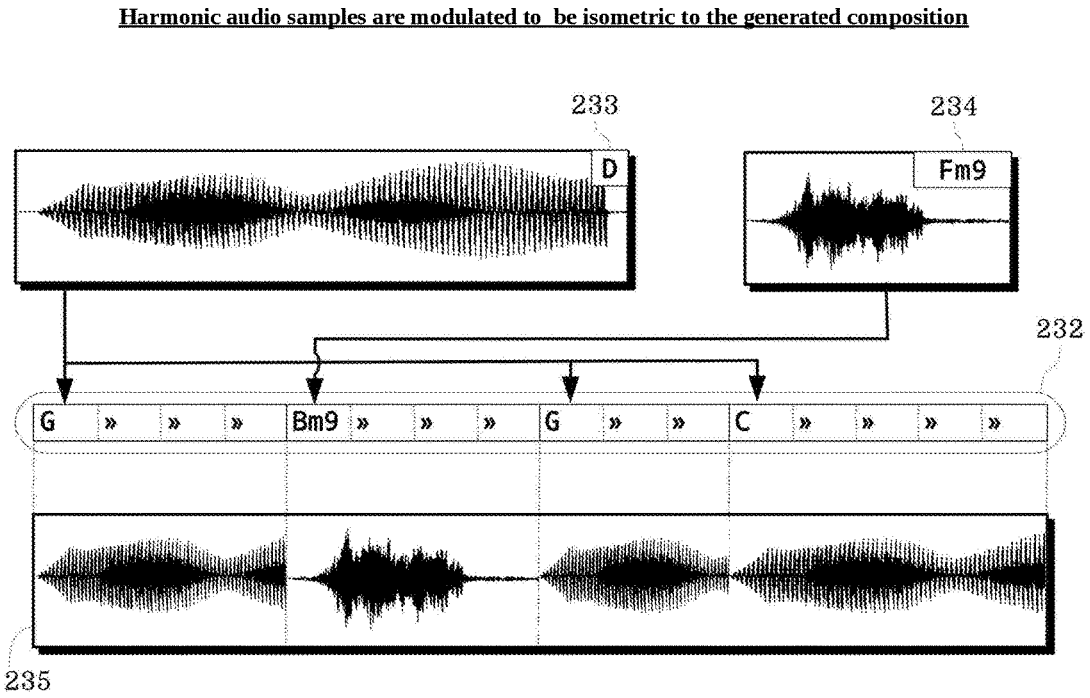
FIG. 15 shows an example of harmonic audio samples modulated to be isometric to the generated musical composition.

The data and method depicted in FIG. 15 shows an example of generation of one segment of harmonic output audio 235 via the arrangement of audio samples 233 and 234 from one harmonic instrument to be isometric to the composite musical composition 232 for the segment.

In FIG. 15, transposed harmonic events 232 are transposed −5 semitones, according to the main-sequence selected for segment 224 (from FIG. 14) determine the harmonic events requiring instrument audio sample fulfillment in the segment.

In FIG. 15, harmonic audio "d" chord 233 is pitch-adjusted and time-scaled to fulfill the selected harmonic events for the segment. Harmonic audio "f minor 9" chord 234 is pitch-adjusted and time-scaled to fulfill the selected harmonic events for the segment. Harmonic audio output 235 is the result of summing the particular selected instrument audio sample at the time, pitch, and scale corresponding to the selected events, for the duration of the segment.

Figure 16:
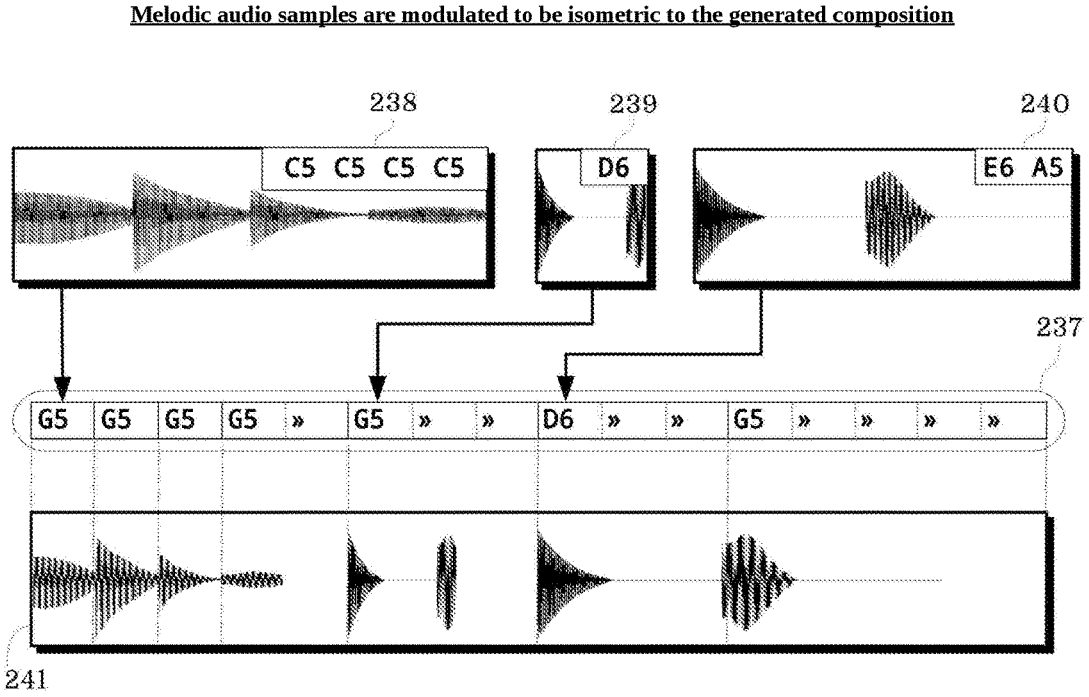
FIG. 16 shows an example of melodic audio samples modulated to be isometric to the generated musical composition.

The data and method depicted in FIG. 16 shows an example of generation of one segment of melodic output audio 241 via the arrangement of audio samples 238, 239, and 240 from one melodic instrument to be isometric to the composite musical composition 237 for the segment.

In FIG. 16, transposed melodic events 237 are identical to the original melodic events, according to the main-sequence selected at segment 221 (from FIG. 14), which is not transposed, determine the melodic events requiring instrument audio sample fulfillment in the segment. The rests indicated by >> in the source instrument are significant, insofar as they align with the rests indicated in the source main-sequence, and the present disclosed technology comprises the system and method by which to successfully select instrument item to match musical compositions based on their isomorphism to the source events.

In FIG. 16, melodic audio "c5 c5 c5 c5" 238 is pitch-adjusted and time-scaled to fulfill the selected melodic events for the segment. Melodic audio "d6" 239 is pitch-adjusted and time-scaled to fulfill the selected melodic events for the segment. Melodic audio "e6 a5" 240 is pitch-adjusted and time-scaled to fulfill the selected melodic events for the segment. Melodic output audio 241 is the result of summing the particular selected instrument item at the time, pitch, and scale corresponding to the selected events, for the duration of the segment.

Figure 17:
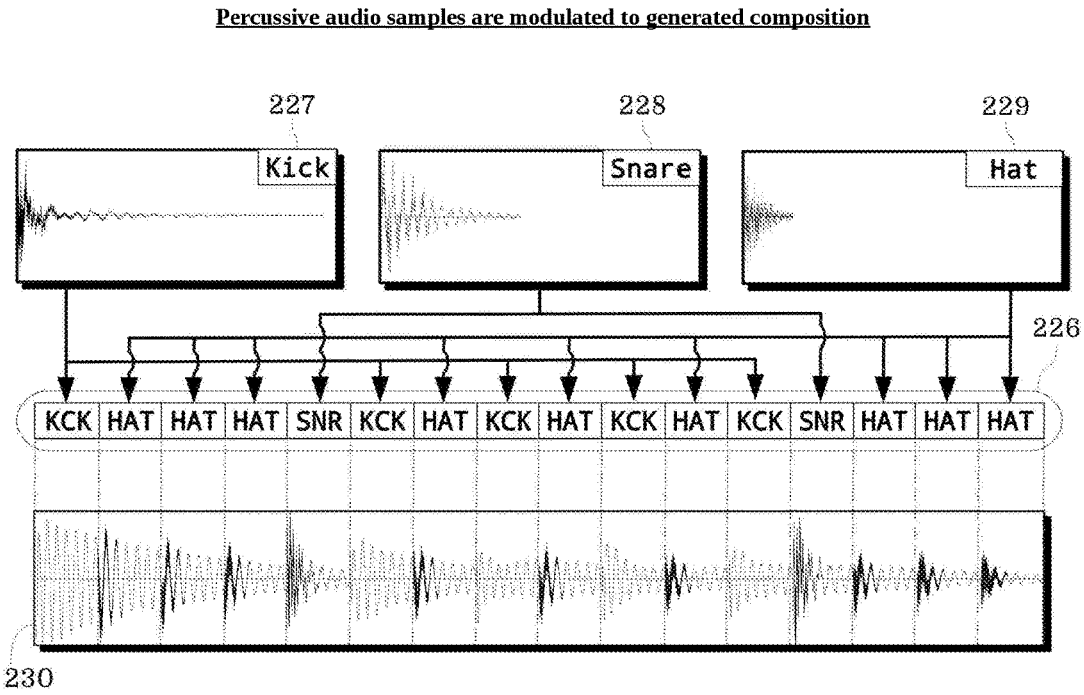
FIG. 17 shows an example of percussive audio samples modulated to be isometric to the generated musical composition.

The data and method depicted in FIG. 17 shows an example of generation of one segment of percussive output audio 230 via the arrangement of audio samples 227, 228, and 229 from one percussive instrument to be isometric to the composite musical composition 226 for the segment.

In FIG. 17, percussive events 226 determine the percussive events requiring instrument item fulfillment in the segment. Percussive audio kick 227 is pitch-adjusted and time-scaled to fulfill the selected percussive events for the segment. Percussive audio snare 228 is pitch-adjusted and time-scaled to fulfill the selected percussive events for the segment. Percussive audio hat 229 is pitch-adjusted and time-scaled to fulfill the selected percussive events for the segment. Percussive output audio 230 is the result of summing the particular selected instrument item at the time, pitch, and scale corresponding to the selected events, for the duration of the segment.

Figure 18:
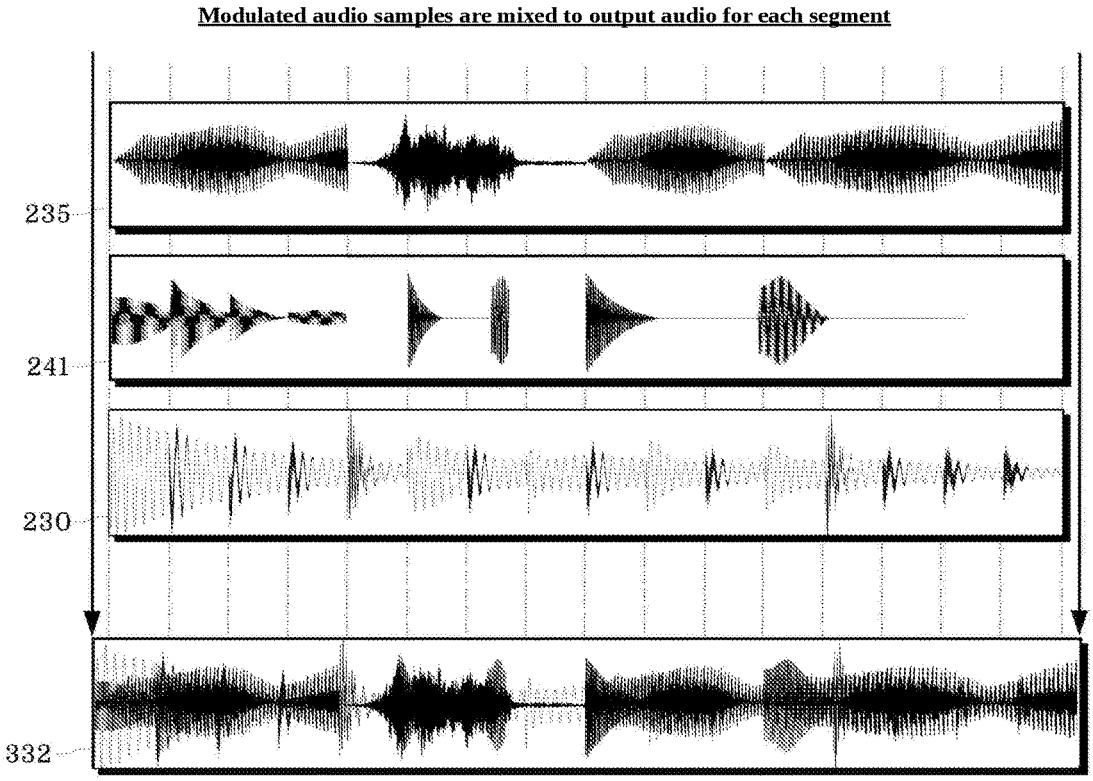
FIG. 18 shows an example of modulated audio samples mixed to output audio for each segment.

The data and method depicted in FIG. 18 shows an example of generation of one segment of final composite segment output audio 332 by mixing individual layers of segment output audio, harmonic segment audio 235, melodic segment audio 241, and percussive segment audio 230. Each segment audio is depicted with only one channel therein, e.g. "Mono," for the purposes of simplicity in illustration. The present disclosed technology is capable of sourcing and delivering audio in any number of channels.

Figure 19:
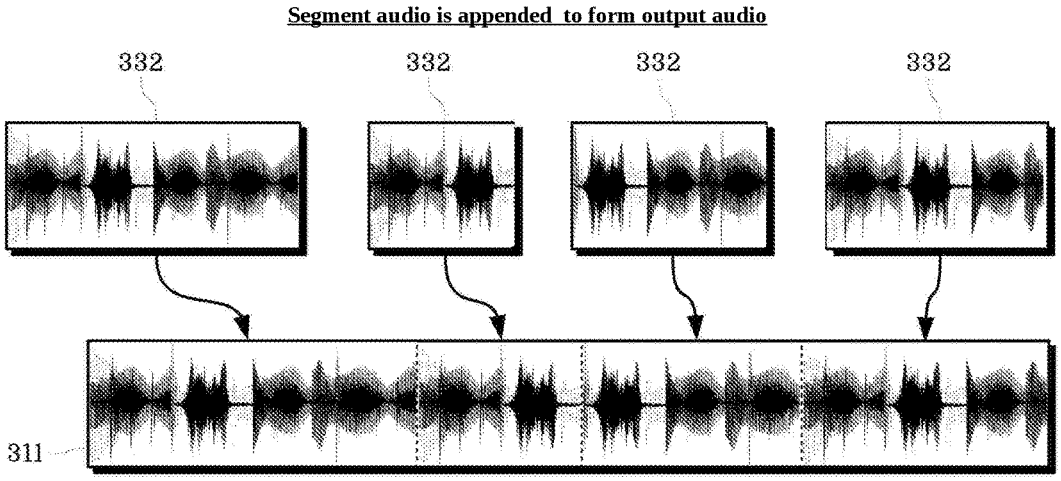
FIG. 19 segment audio is appended to form output audio.

The data and method depicted in FIG. 19 shows an example of generation of output audio 311 by appending a series of segment output audio 332.

It will thus be seen that the objects set forth above, among those made apparent from the preceding description, are efficiently attained and, because certain changes may be made in carrying out the above method and in the construction(s) set forth without departing from the spirit and scope of the disclosed technology, it is intended that all matter contained in the above description and shown in the accompanying drawings shall be interpreted as illustrative and not in a limiting sense. It is also to be understood that the following claims are intended to cover all of the generic and specific features of the disclosed technology herein described and all statements of the scope of the disclosed technology which, as a matter of language, might be said to fall between.

Variations, modifications, and other implementations of what is described herein will occur to those of ordinary skill in the art without departing from the spirit and the scope of the disclosed technology as claimed. Accordingly, the disclosed technology is to be defined not by the preceding illustrative description but instead by the following claims.

I claim:

1. A method for generation of a musical audio composition, based on a collection of musical sequences, macro-sequences, and musical instrument audio samples, said method comprising steps of:

receiving an input of at least some said musical sequences each comprising at least a root key and at least one musical chord, receiving an input of at least some said musical macro-sequences each comprising a series of at least two musical keys, receiving an input of at least some said instrument audio samples each comprising audio data representing a musical performance and structured data representing said performance as musical events, selecting and transposing at least some of a series of selected macro-sequence, such that two macro-sequences placed adjacent in time will overlap terminus keys such that both share a single key during said overlap, selecting and transposing at least some of a series of sequences, such that the root keys of said selected sequences are equal to the keys of said selected macro-sequences and chords of said selected sequences are transposed to match said transposed root key, combining at least some of said selected sequences such as to form a composite musical sequence, searching each of said plurality of audio sample for musical characteristics isometric to those of at least part of said composite sequence, selecting and modulating at least some of said audio samples, and combining said modulated audio to form a musical audio composition.

2. The method of claim 1, further comprising:

receiving an input of at least one rhythm sequence having at least some percussive events, selecting at least some of a series of rhythm sequences, and including said selected rhythm sequences in said selection of audio samples.

3. The method of claim 1, further comprising:

receiving an input of at least one detail sequence having at least some musical events, selecting at least some detail sequences, and including said selected detail sequences in said selection of audio samples.

4. The method of claim 1, further comprising:

said given collection of musical sequences and partial audio samples each are assigned at least one meme from a set of memes contained therein, matching common memes during said comparison of sequences, and matching common memes during said comparison of audio samples.

5. The method of claim 1, further comprising:

receiving an input of at least one groove sequence having at least some information about timing musical events for particular effect, selecting at least some groove sequences, and factoring said selected groove sequences in generation of said composite sequence.

6. The method of claim 1, further comprising:

receiving an input of at least one vocal sequence having at least some text, selecting at least some vocal sequences, and including said selected vocal sequences in said selection of audio samples.

7. The method of claim 1, further comprising:

receiving an input of at least one partial sub-sequence within said musical sequences, selecting at least some partial sub-sequences, and including said selected sub-sequences in said combination of sequences.

8. The method of claim 1, further comprising:

receiving an input of at least some human user interaction, and considering said interaction while performing said selection or modulation of musical sequences, macro-sequences, or musical instrument audio.

9. The method of claim 1, further comprising:

receiving an input of at least some human listener feedback pertaining to final output audio, performing mathematical computations based on said feedback, and considering result of said computations while performing said selection or modulation of musical sequences, macro-sequences, or musical instrument audio.

10. The method of claim 1, further comprising:

generate metadata representing all final said selections of said sequences, said instruments, and said arrangement of audio samples, and output said metadata.

11. A device which carries out said method of claim 1.

* * * * *